United States Patent [19]

Ariga

[11] 4,290,707

[45] Sep. 22, 1981

[54] WRITING INSTRUMENT HAVING MULTIPLE WRITING ELEMENTS

[76] Inventor: Tatsuo Ariga; 16-19, Haneki 1-Chome, Setagaya-ku, Tokyo, Japan

[21] Appl. No.: 22,879

[22] Filed: Mar. 22, 1979

[30] Foreign Application Priority Data

Mar. 31, 1978 [JP] Japan ..... 53/40983[U]

[51] Int. Cl.[3] ..... B43K 5/16; B43K 24/02

[52] U.S. Cl. ..... 401/110; 401/17; 401/19; 401/33

[58] Field of Search ..... 401/17, 19, 20, 29, 401/30, 32, 33, 109, 110

[56] References Cited

U.S. PATENT DOCUMENTS

| | | | |
|---|---|---|---|
| 3,266,465 | 8/1966 | Ganz | 401/33 |
| 4,148,591 | 4/1979 | Tomura | 401/32 |
| 4,227,822 | 10/1980 | Kokubu | 401/17 |

*Primary Examiner*—Robert W. Michell
*Assistant Examiner*—J. L. Kruter
*Attorney, Agent, or Firm*—Steinberg & Raskin

[57] ABSTRACT

An improved writing instrument having multiple writing elements, i.e., a mechanical lead pencil element and at least one other writing element, which are selectively movable into operating position by rotation of a cam and wherein lead can be moved from the pencil element by axial movement of the housing element. The instrument comprises a sleeve-type cam having a transformed end face cam surface, the contour of which preferably comprises downwardly sloping edges having a generally elliptical shape which guide a pair of cam followers respectively associated with the writing elements. According to the invention, the cam has an upper, substantially vertical portion which allows the lead of the mechanical pencil to be pushed out from the supporting element by urging the cam axially downwardly whereby the cam follower associated with the other writing element can slide adjacent to the vertically extended cam portion, the cam being fixed to a housing element which can rotate and axially move with the cam element.

5 Claims, 5 Drawing Figures

WRITING INSTRUMENT HAVING MULTIPLE WRITING ELEMENTS

BACKGROUND OF THE INVENTION

The invention relates to an improved writing instrument of ball and lead points of turn and push style.

The known writing instrument of U.S. Pat. No. 3,266,465 can be used only for the ball point but cannot be used for the lead point of a mechanical pencil because it does not have any mechanism whereby the lead point can be pushed out of the writing instrument.

The invention has improved the said instrument possibly for use with the lead point also without any separate knob to push down, by means of an axially movable and rotatable sleeve-type cam which has a transformed end cam edge, the contour of which preferably comprises two sloped ellipses which vertically reciprocate two followers for the ball and lead points respectively, said cam edge contour having a vertical upper linear portion which allows the lead point to be pushed out of the said instrument by sliding said follower for ball point will slide along said linear portion, said sleeve cam being fixed to an actuater cap which can rotate and move up-and-down also.

BRIEF SUMMARY OF THE INVENTION

The present invention comprises an improved writing instrument having ballpoint pen and mechanical pencil elements selectively movable into operating position by rotation of a sleeve-type cam and wherein the lead of the pencil can be indexed outwardly by an axial pushing motion of the cam. The lower end of the cam preferably comprises a pair of downwardly extending edges which are sloped towards each other, preferably elliptical in configuration, which guide two followers for said ball and lead points, said contour having a vertical upper linear portion along which said follower for said ball point can slide when the cam is pushed down to urge the ball point out of said instrument.

DESCRIPTION OF THE PREFERRED EMBODIMENTS

Figure 1:
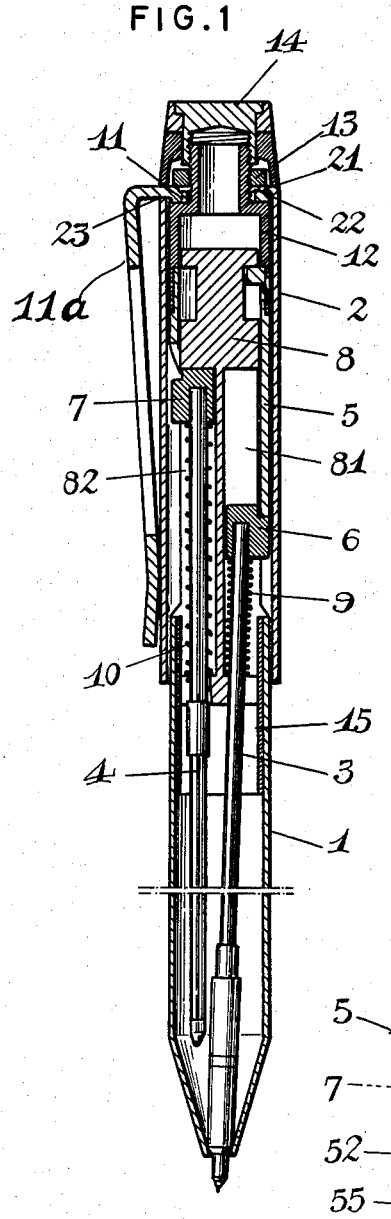
FIG. 1 is an axially enlarged cross-sectional view of the improved writing instrument of ball and lead points of turn and push style according to the invention when said lead point is in position for use.
Figure 2:
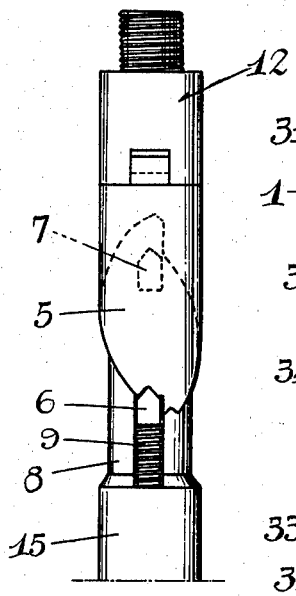
FIG. 2 is a fragmentary side view of FIG. 1.

The improved writing instrument of the invention comprises a hollow substantially cylindrical holder 1, a housing element which functions as an actuator 2, a lead-point supporter or mechanical pencil element 3 and a ball-point supporter or ball point pen element 4. The actuator 2 can be revolved and pushed by manual fingers, i.e., can be rotated or axially moved with respect to the holder 1. The actuator 2 covers an upper part of the holder 1.

A cam 5 is fixed within the actuator 2 as described below.

Followers 6 and 7 are mounted respectively on the upper ends of the supporters 3, 4, each follower having a pointed upper end as seen in the drawings. The supporters are urged upwardly as described below in a manner such that the cam followers are always engaged with the cam edge of cam 5. Rotation of cam 5 will thereby move the followers 6, 7 axially and reciprocatively.

A guide element 8 having a pair of grooves 81, 82 is inserted into the cam 5 in a manner such that the cam can rotate. The upper portions of the supporters 3, 4 and the respective followers 6, 7 are slidingly received in the respective grooves 81, 82. As seen in the drawings, each follower engages a respective one of the cam surface portions 51, 52 so that rotation of the cam 5 causes the respective supporters 3, 4 to move axially in opposite directions.

Coil springs 9, 10 are set in the grooves 81, 82 around respective supporters 3, 4, their upper ends bearing against the followers 6, 7 and their lower ends bearing against inwardly facing shoulders formed in the lower regions of grooves 81, 82.

Further, an innerly bent rim 21 is formed at the top of the actuator 2 defining an upper opening 22 and a convex cut 23 is formed partly at rim 21 through which a pocket clip member 11a passes having a ring 11 which is concentric with the opening 22.

A head member 12 is fixed to the cam 5 and projects through the opening 22 and the ring 11.

A screw ring 13 is fitted around the head 12 and mounted on the ring 11 and the rim 21.

A cap 14 is screwed by the head 12.

A lower portion of the guide element 8 is situated within an assisting tube 15. Thus, an annular shoulder of the former engages the upper end of the latter. The holder 1 is inserted by press fit over the tube 15.

Figure 4:
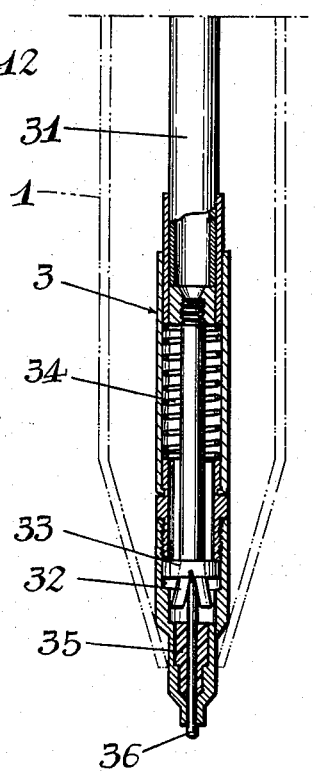
FIG. 4 is an axially enlarged fragmentary cross-section of said instrument of the invention when using said lead point.

Referring to FIG. 4, the lead-point supporter 3 comprises a push pipe 31, a chuck pipe 32, a ring 33, a coil spring 34, a sponge material 35 and a lead 36. The lead 36 is made of graphite or crayon core.

Figure 3:
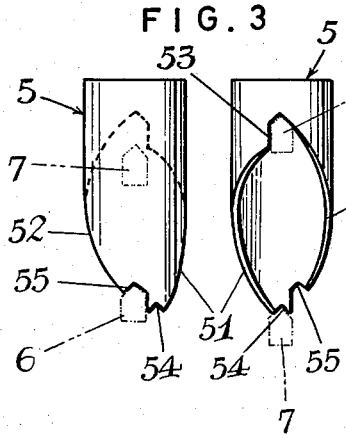
FIG. 3 is an explanatory view illustrating the relationship between the cam and two followers for ball and lead points when said cam rotates.
Figure 5:
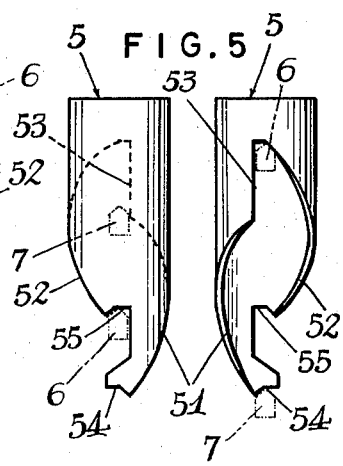
FIG. 5 is an explanatory view corresponding to FIG. 3 illustrating another embodiment of said cam.

Referring to FIGS. 3 and 5, the cam 5 has a substantially cylindrical configuration, the downwardly facing edge thereof comprising a cam edge, comprising a curve sloping edge portion 51 is formed and sloped on a side of a lower end of the cam 5. The edge 51 preferably has an elliptical shape. A second curved sloping edge portion 52, preferably having an elliptical configuration is also provided. The elliptical shape of the cam portions 51, 52 are preferably the same but displaced vertically with respect to each other. The followers 6, 7 respectively engage the cam portions 51, 52 and are axially moved within grooves 81, 82 upon rotation of the cam 5.

According to the invention, a vertical linear cam portion 53 is formed between the upper ends of the cam portions 51, 52 interconnecting the same. To move the lead 36 outwardly, the cam 5 is rotated to the position shown in FIGS. 1 and 3 (lefthand figure) whereupon the cam is urged axially downwardly with the actuator 2. The follower 7 will not be moved downwardly since the same is substantially aligned with the linear cam portion 53 and will slide adjacent thereto upon the cam being moved downwardly.

Two convex parts 54, 55 are respectively formed at bottoms of the curved cam portions 51, 52 to connect therewith.

The follower 6 will stop at the convex part 55 when the lead pencil is in its operative position whereas the follower 7 will stop at the other convex part 54 when the pen is in its operative position.

FIG. 5 illustrates an embodiment of the cam 5 wherein the convex parts 54, 55 are vertically aligned over each other.

It will thus be seen that according to the invention the improved writing instrument of ball and lead points of turn and push style makes it possible to revolve the upper part thereof to convert the ball-point into the lead-point and then to feed the lead to make the lead-point out thereof by forcing down the said upper part thereof with finger action; without necessity of any knob to push down.

As many embodiments of the invention may be made without departing from the spirit and scope thereof, it is to be understood that the invention includes all such modifications and variations as come within the scope of the appended claims.

What I claim is:

1. In a writing instrument having multiple writing elements, one of which includes a mechanical pencil element, wherein each of said writing elements has a cam follower fixed to the upper end thereof and further including a sleeve-type cam mounted for rotation and axial movement with respect to said writing elements, said cam including a pair of cam edge portions sloping downwardly towards each other, each of said cam followers being biased into engagement with a respective one of said cam edge portions, the improvement comprising:

said sleeve-type cam having a substantially vertically extending edge portion interconnecting the upper ends of said cam edge portions, whereby upon said pencil element being moved to its operative position, the cam follower fixed to the upper end of said other writing element is substantially aligned with the vertically extending edge portion so that upon axially moving the cam, the cam follower aligned with the vertically extending cam edge portion will not be moved; a head member having an axial portion fixed to the upper end of said cam; a clip member having a ring portion located over said axial portion of said head member; an actuator housing element having an open top; said cam and head member being fixed to said housing element with said axial portion extending through said open top; a retainer ring fixed to said axial portion for retaining the ring portion of said clip member in position; and a cap member fixed to said axial portion.

2. The combination as recited in claim 1 wherein a notch is formed at the lower end of each of said sloping cam edge portions, each notch being adapted to receive the respective cam follower which engages the respective cam edge portion when the writing element with which the follower is associated is moved into its operative position.

3. The combination as recited in claim 2 wherein said notches are vertically aligned with respect to each other.

4. The combination as recited in claim 1 wherein said sloping cam edge portions each has an elliptical configuration.

5. The combination as recited in claim 4 wherein said elliptical cam edge portions are substantially parallel to and vertically spaced from each other.

* * * * *